US005364285A

United States Patent [19]

Sakurai

[11] Patent Number: 5,364,285

[45] Date of Patent: Nov. 15, 1994

[54] WATERPROOF CONNECTOR

[75] Inventor: Kazuaki Sakurai, Shizuoka, Japan

[73] Assignee: Yazaki Corporation, Tokyo, Japan

[21] Appl. No.: 155,756

[22] Filed: Nov. 23, 1993

[30] Foreign Application Priority Data

Nov. 24, 1992 [JP] Japan ..... 4-086126[U]

[51] Int. Cl.[5] ..... H01R 4/70

[52] U.S. Cl. ..... 439/275; 439/589

[58] Field of Search ..... 439/274, 275, 587, 865–868, 439/589

[56] References Cited

U.S. PATENT DOCUMENTS

| | | | |
|---|---|---|---|
| 3,844,923 | 10/1974 | Sandrock | 439/865 |
| 4,772,235 | 9/1988 | Lustig | 439/866 |
| 4,895,533 | 1/1990 | Yagi et al. | 439/587 |
| 4,921,437 | 5/1990 | Cooper et al. | 439/275 |
| 5,147,222 | 9/1992 | Hotea et al. | 439/589 |
| 5,224,875 | 9/1993 | Watanabe et al. | 439/587 |

FOREIGN PATENT DOCUMENTS

| | | | |
|---|---|---|---|
| 0348269A1 | 12/1989 | European Pat. Off. . | |
| 62-26871 | 2/1987 | Japan . | |
| 63-18779 | 2/1988 | Japan . | |
| WO88/02940 | 4/1988 | WIPO . | |
| 9000819 | 1/1990 | WIPO | 439/275 |
| WO92/16985 | 10/1992 | WIPO . | |

*Primary Examiner*—Gary F. Paumen

*Attorney, Agent, or Firm*—Finnegan, Henderson, Farabow, Garrett & Dunner

[57] ABSTRACT

In the connection between a terminal of an electric automobile and a covered wire, a rubber plug fitted on the wire and disposed between the terminal and the wire is properly positioned, thereby not only enhancing the efficiency of the assembling operation but also reducing damage to the rubber plug. The rubber plug has at its inner peripheral surface a retaining step against which an end surface of an insulative sheath of a covered wire abuts. A terminal has a wire connection portion defined by one end portion thereof, and an engagement hole is formed in this wire connection portion. An abutment shoulder against which a front end 10*c* of the rubber plug is adapted to abut is formed at the engagement hole. Conductors of the covered wire and the front end portion of the rubber plug are inserted into the engagement hole, and then are compressed from the outer side.

3 Claims, 3 Drawing Sheets

PRIOR ART

WATERPROOF CONNECTOR

BACKGROUND OF THE INVENTION

1. Field of the invention

This invention relates to a waterproof connector, and more particularly to the construction of mounting a rubber plug (waterproof packing) between a terminal and an electric wire.

2. Related Art

In order to impart an enhanced waterproof ability to an electric connector, it is necessary to use a housing of a liquid-tight construction, and it is also necessary to provide a liquid-tight construction between the housing and the wire having a terminal attached thereto, the terminal being adapted to be inserted into and fixed to a housing. Therefore, it is a common practice to provide a waterproof packing, through which an electric wire extends, at a portion of connection between the wire and the terminal.

As a conventional waterproof terminal, there is known a construction (cf. Unexamined Japanese Utility Model Publication Nos. 62-26871 and 63-18779) shown in FIGS. 6 and 7, in which a hollow cylindrical waterproof packing 4 of an elastic material, such as rubber or a synthetic resin, is fitted on an insulation 2 of an electric wire 1 from which part of conductors are exposed, and clamp pawls 7 of a metal terminal 6 are compressively clamped to a tubular portion 5 of the packing 4, and further an insulation barrel 8 is press-connected to the conductors 3, thereby connecting the metal terminal 6 and the wire 1 together.

In the above construction, the terminal need to be press-connected by the clamp pawls 7 in such a manner that a cut end surface 2*a* of the insulation lies flush with an end surface 5*a* of the tubular portion, or the end surface 5*a* of the tubular portion lies slightly rearwardly of the end surface 2*a* of the insulation.

Namely, it is necessary that the insulation and the packing, as well as the packing and the terminal, should be compressively connected together in such a manner that the two are properly positioned with respect to each other. If the compressive connection is done without such proper positioning (for example, if the compressive clamping is done in such a manner that the insulation is extended to the insulation barrel to overlap part of this barrel), this invites an imperfect conduction. If the clamp pawls are disposed so rearwardly that the packing and the insulation are compressively clamped by these clamp pawls in such a manner that the clamp pawls overlap the end of the packing and the insulation, the packing is broken, and the packing is withdrawn rearwardly because of an insufficient compressive clamping force applied by the clamp pawls. For these reasons, it has been necessary to effect the terminal clamping operation in such a manner that the packing, the terminal and the wire are accurately held in their respective proper positions.

However, to effect the clamping operation with the above three parts thus held in their respective proper positions has required much time and labor, and has been extremely poor in the efficiency of the operation.

SUMMARY OF THE INVENTION

The present invention has been made in view of the foregoing, and the invention is suited particularly with the case where an electric wire is designed to receive high voltage and current, and therefore has an insulative sheath whose thickness is more than a predetermined value so that a waterproof packing has also an increased diameter. For example, the invention is effective for a terminal for an electric automobile. An object of the invention is to provide a waterproof connector which enables constituent parts to be easily positioned with respect to one another, and prevents damage to the waterproof packing, and improves the prevention of withdrawal of the waterproof packing.

The object of the present invention has been achieved by a waterproof connector comprising a waterproof packing having a step portion on its inner peripheral surface of a generally hollow cylindrical shape fitted on a covered wire having an exposed conductor, an end surface of an insulative sheath of the covered wire being abutted against the step portion, and the packing including a larger-diameter portion adapted to be held in intimate contact with an outer surface of the insulative sheath, and a smaller-diameter portion extending forwardly from the larger-diameter portion; and a terminal comprising a rod-like member having an engagement hole formed in one end portion thereof, the engagement hole having at its inner peripheral surface a step portion against which a front end of the smaller-diameter portion is abutted, the conductor and the smaller diameter portion being inserted into the engagement hole, the engagement hole being compressed to fasten the covered wire, and the terminal being fitted in a housing.

In the waterproof connector of the present invention having the above construction, the waterproof packing has at its inner peripheral surface the retaining step portion against which the end surface of the insulative sheath abuts. Furthermore, the terminal has the abutment shoulder formed on the inner peripheral surface of the engagement hole against which abutment shoulder the front end of the waterproof packing abuts. Therefore, by inserting the packing and the wire until the front end of the packing is brought into abutment against the abutment shoulder, the positioning can be easily effected.

DETAILED DESCRIPTION OF THE PREFERRED EMBODIMENTS

Figure 1:
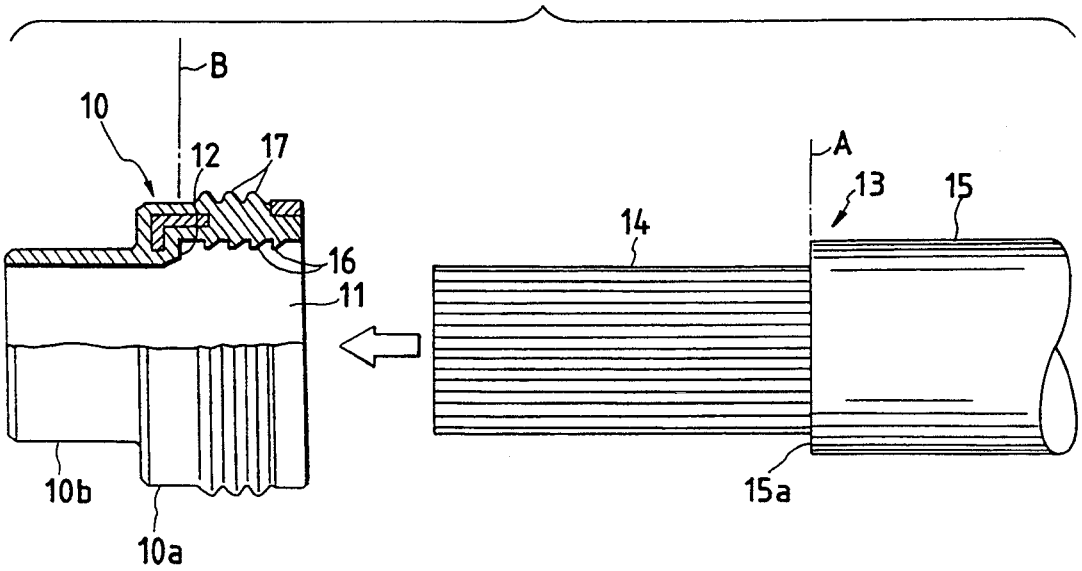
FIG. 1 is a partial cross-sectional view showing a rubber plug and an electric wire, used in a preferred embodiment of the present invention, before they are assembled together.

A preferred embodiment of a waterproof connector of the present invention will now be described with reference to the drawings.

One preferred embodiment of this invention will now be described with reference to FIGS. 1 to 4. In this embodiment, a terminal suited for feeding power particularly in an electric automobile will be described as an example.

A waterproof packing comprises a rubber plug 10 of a generally hollow cylindrical shape which includes a larger-diameter portion 10*a*, and a smaller-diameter portion 10*b* extending forwardly from the larger-diameter portion 10*a*, the rubber plug 10 having a wire insertion hole 11 formed therethrough along a centerline or axis thereof.

A retaining step 12 is formed on an inner peripheral surface of the wire insertion hole 11 at the larger-diameter portion 10*a*, and extends over an entire inner periphery thereof. The retaining step 12 is adapted to abut against an end surface 15*a* of an insulative sheath 15 of a covered wire 13 from which conductors 14 are exposed at an end portion of the wire. That portion of the wire insertion hole 11 corresponding to the larger-diameter portion 10*a* is of such a size and shape that said that portion can be held in intimate contact with an outer peripheral surface of the insulative sheath 15. In order to more positively achieve the intimate contact with the wire, a plurality of projections 16 are formed on an inner surface of said that portion over an entire inner periphery thereof, and are spaced from one another in the axial direction. Furthermore, a plurality of flanges 17 are formed on an outer peripheral surface of the larger-diameter portion 10*a* so as to be held in intimate contact with a connector housing 22 to enhance a waterproof effect when a terminal 18 (later described) is attached to the housing 22, these flanges 17 being spaced from one another in the axial direction.

Figure 2:
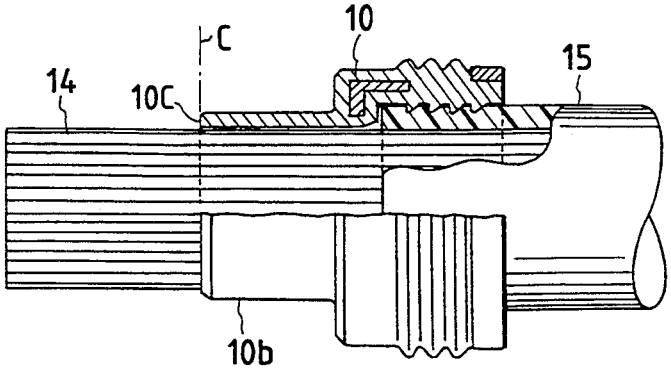
FIG. 2 is a partial cross-sectional view showing the rubber plug fitted on the wire.

The covered wire 13, having the end portion from which the insulative sheath 15 has been removed to expose the conductors 14, is fitted in and is extended through the rubber plug 10 of the above construction. At this time, the wire 13 is inserted in such a manner that the end surface 15*a* of the insulative sheath 15 indicated by a line A (FIG. 1) is brought into abutment against the retaining step 12 indicated by a line B. This condition is shown in FIG. 2. Then, the wire 13 and the rubber plug 10 disposed in this condition is to be connected to the terminal.

Figure 3:
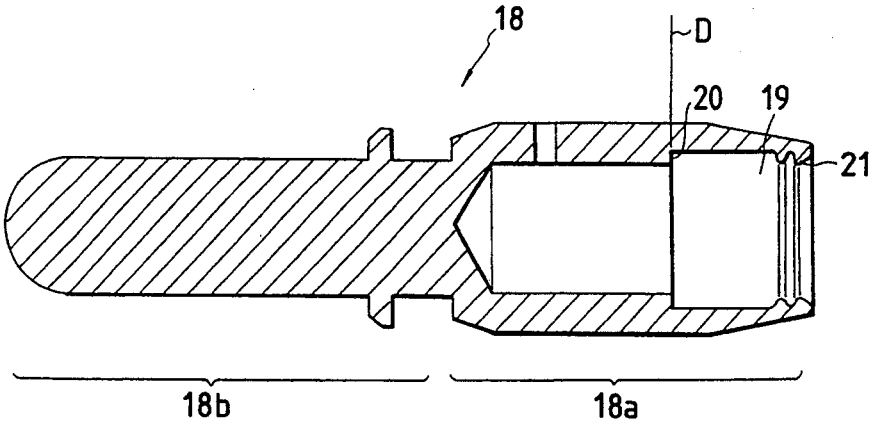
FIG. 3 is a longitudinal cross-sectional view of a male terminal used in the preferred embodiment of the invention.

The terminal 18 used in this embodiment is constructed as shown in FIG. 3, and is formed by cutting a metal rod of a round cross-section. One end portion of the terminal 18 defines a wire connection portion 18*a*. The wire connection portion 18*a* has an engagement hole 19 into which the smaller-diameter diameter portion 10*b* of the rubber plug 10 and the conductors 14 can be inserted, the engagement hole 19 having a closed front end. An abutment shoulder 20 against which a front end 10*c* of the smaller-diameter portion 10*b* is adapted to abut is formed on an inner surface of the engagement hole 19 over an entire inner periphery thereof. A front end portion of the engagement hole 19 extending from the abutment shoulder 20 is smaller in diameter than the inlet portion of the engagement hole, and the conductors 14 can be inserted into this front end portion. A plurality of projections 21 for suitably retaining the smaller-diameter portion 10*b* are formed on that portion of the inner surface of the engagement hole 19 disposed adjacent to the inlet of this engagement hole, and are spaced from each other in the axial direction. The other end portion of the terminal 18 defines an electrical connection portion 18*b*, and is adapted to be connected to a mating terminal. In this embodiment, the electrical connection portion 18*b* is formed as a solid male terminal having a rounded distal end.

Figure 4:
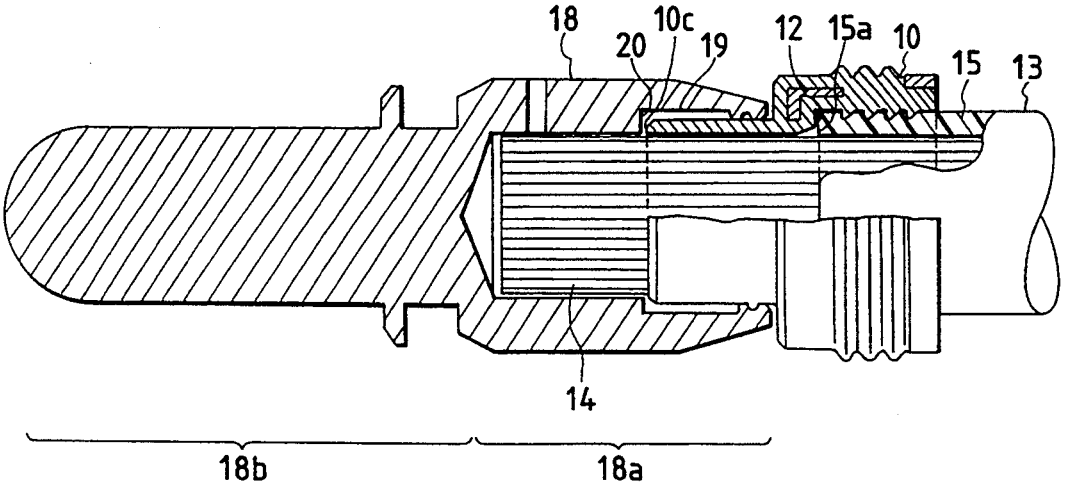
FIG. 4 is a partial cross-sectional view showing the wire and the rubber plug compressively fastened to the terminal.

The covered wire 13, inserted through the rubber plug 10 as shown in FIG. 2, is connected to the terminal 18 in such a manner that the exposed conductors 14 are inserted, together with the smaller-diameter portion 10*b* of the rubber plug 10, into the engagement hole 19. At this time, the wire 13 is pushed until the front end 10*c* of the rubber plug 10 indicated by a line C (FIG. 2) is brought into abutment against the abutment shoulder 20 of the engagement hole 19 indicated by a line D (FIG. 3). Then, the wire connection portion 18*a* corresponding to the engagement hole 19 is compressed into a hexagonal outer shape by a hydraulically-operated die head. The thus assembled terminal is shown in FIG. 4. Simultaneously when the conductors 14 of the wire 13 are compressively fastened to the engagement hole 19 of the terminal 18, the rubber plug 10 is held and fixed between the terminal 18 and the conductors 14. Merely by pushing the wire until the front end 10*c* of the rubber plug 10 is brought into abutment against the abutment shoulder 20 and also by pushing the wire until the end 15*a* of the insulative sheath 15 is brought into abutment against the retaining step 12 of the rubber plug 10, the positioning of the terminal 18 with respect to the wire 13 and the rubber plug 10 is effected easily.

Figure 5:
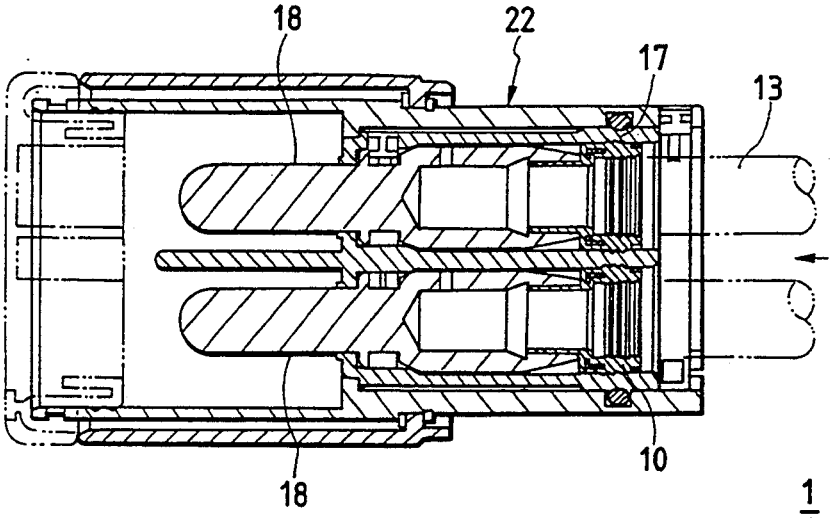
FIG. 5 is a cross-sectional view of a connector, showing the terminals as fastened to a housing.
Figure 6:
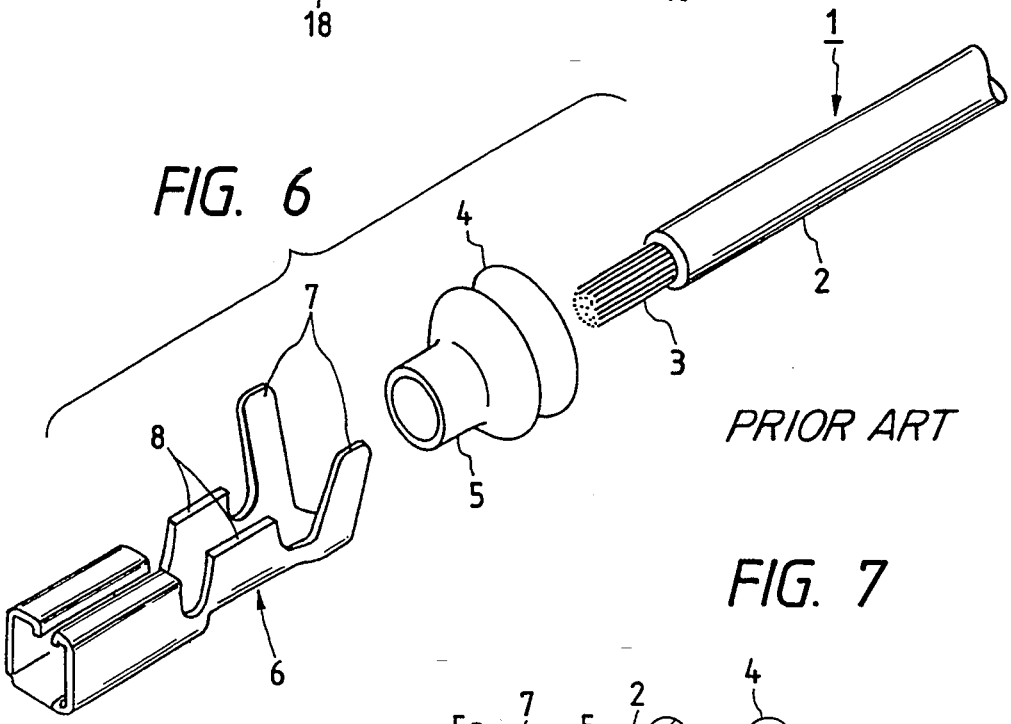
FIG. 6 is an exploded perspective view of a conventional construction.
Figure 7:
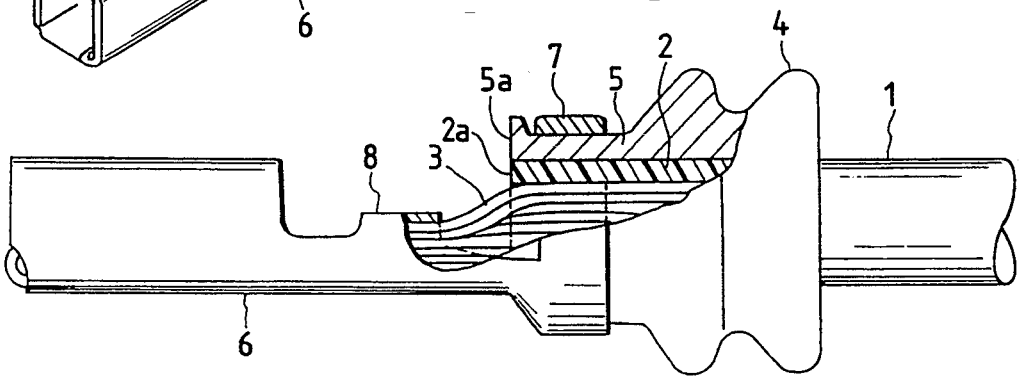
PRIOR ART FIG. 7
FIG. 7 is a cross-sectional view, showing a terminal of FIG. 6 in an assembled condition.

The terminal 18 having the wire 13 connected thereto is inserted into the housing 22 as shown in FIG. 5, and the flanges 17 formed on the rubber plug 10 is held in a cavity in an intimately contacted manner, thereby positively achieving a waterproof effect.

As described above, in the waterproof connector of the present invention, the positioning of the rubber plug with respect to the terminal, as well as the positioning of the rubber plug with respect to the wire, can be easily effected when they are to be connected together, and in this manner the covered wire can be compressively connected to the terminal. Therefore, the efficiency of the operation is markedly enhanced.

Furthermore, the smaller-diameter portion of the rubber plug is fitted in the engagement hole over the entire peripheral surface thereof, and is compressed into a hexagonal shape. Therefore, in contrast with the conventional method in which the metal terminal is compressively clamped on part of the periphery, the rubber plug is subjected to less damage, and the effect of preventing the withdrawal of the rubber plug is much enhanced.

Moreover, thanks to the rubber plug fitted on the conductor portion of the wire, this conductor portion is less liable to be loosened, and therefore the conductor portion can be easily inserted into the engagement hole, which enhances the efficiency of the operation.

What is claimed is:

1. A waterproof packing comprising:

a larger-diameter member including:

a retaining step portion defined on an inner peripheral surface of the larger diameter member, the step portion being abutted against an end surface of an insulative sheath of a wire;

a plurality of projections formed on the inner surface of inner periphery of the larger-diameter member to hold the wire;

a plurality of flanges formed on an outer peripheral surface of the large-diameter member, the flange adapted to be attached to a connector housing; and a unitary smaller diameter member extending forwardly from the large diameter member.

2. A waterproof terminal assembly comprising:

a waterproof elastomeric packing comprising:

a larger-diameter member including:

a retaining step portion defined on an inner peripheral surface of the larger diameter member, the step portion being abutted against an end surface of an insulative sheath of a wire;

a plurality of projections formed on the inner surface of inner periphery of the larger-diameter member to hold the wire;

a plurality of flanges formed on an outer peripheral surface of the large-diameter member, the flange adapted to be attached to a connector housing; and a unitary smaller-diameter member extending forwardly from the large diameter member; and a terminal including a wire connection portion defined on one end portion thereof, the wire connection portion having an engagement hole having an abutment shoulder being formed on an inner surface of the engagement hole in such a manner that a front end of the smaller-diameter member is abutted against the abutment shoulder, the wire connection portion having a plurality of projections for suitably retaining the small-diameter member.

3. A waterproof connector comprising:

a waterproof elastiomeric packing comprising:

a larger-diameter member including:

a step portion defined on an inner peripheral surface of the larger diameter member in a hollow cylindrical shape, the step portion being abutted against an end surface of an insulative sheath of a wire;

a plurality of projections formed on the inner surface of inner periphery of the larger-diameter member;

a plurality of flanges formed on an outer peripheral surface of the large-diameter member adapted to be attached to a connector housing;

a unitary smaller-diameter member extending forwardly from the large diameter member;

a terminal including a wire connection portion defined on one end portion thereof, the wire connection portion having an engagement hole having an abutment shoulder being formed on an inner surface of the engagement hole in such a manner that a front end of the smaller-diameter member is abutted against the abutment shoulder, the wire connection portion having a plurality of projections for suitably retaining the small-diameter member; and the connector housing having a receiving chamber for receiving the terminal to thereby achieve a waterproof effect by inserting the flanges of the larger-diameter member into the receiving chamber.

* * * * *

UNITED STATES PATENT AND TRADEMARK OFFICE

CERTIFICATE OF CORRECTION

PATENT NO. : 5,364,285

DATED : November 15, 1994

INVENTOR(S) : Kazuaki SAKURAI

It is certified that error appears in the above-indentified patent and that said Letters Patent is hereby corrected as shown below:

Claim 2, Column 5, Line 26, change "small" to --smaller--.

Claim 3, Column 5, Line 28, change "elastiomeric" to --elastomeric--.

Claim 3, Column 6, Line 22, change "small" to --smaller--.

Signed and Sealed this

Twenty-seventh Day of June, 1995

*Attest:*

Bruce Lehman

BRUCE LEHMAN

*Attesting Officer*

*Commissioner of Patents and Trademarks*